US010038238B2

(12) United States Patent
Elsaadani

(10) Patent No.: US 10,038,238 B2
(45) Date of Patent: Jul. 31, 2018

(54) LOAD-RESISTANT ANTENNA MOUNT

(71) Applicant: Radio Frequency Systems, Inc., Meriden, CT (US)

(72) Inventor: Asaad R Elsaadani, Meriden, CT (US)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 224 days.

(21) Appl. No.: 15/199,284

(22) Filed: Jun. 30, 2016

(65) Prior Publication Data

US 2018/0006368 A1 Jan. 4, 2018

(51) Int. Cl.

| | |
|---|---|
| ***H01Q 3/04*** | (2006.01) |
| ***H01Q 1/50*** | (2006.01) |
| ***H01Q 15/14*** | (2006.01) |

(52) U.S. Cl.
CPC ..... *H01Q 3/04* (2013.01); *H01Q 1/50* (2013.01); *H01Q 15/14* (2013.01)

(58) Field of Classification Search
CPC ..... H01Q 3/04; H01Q 1/50; H01Q 15/14
USPC ..... 343/763
See application file for complete search history.

(56) References Cited

U.S. PATENT DOCUMENTS

| | | | |
|---|---|---|---|
| 5,945,961 | A | 8/1999 | Price et al. |
| 6,043,795 | A | 3/2000 | Strieffler et al. |
| 6,088,002 | A | 7/2000 | Johnson et al. |
| 8,760,361 | B2 | 6/2014 | Lewry et al. |

FOREIGN PATENT DOCUMENTS

WO 2013126108 A1 8/2013

*Primary Examiner* — Andrea Lindgren Baltzell
(74) *Attorney, Agent, or Firm* — Andrew R. Ralston

(57) ABSTRACT

A mechanical assembly provides an attachment of an antenna tower to an antenna that includes back ring attached to an antenna reflector. The assembly includes a horizontal beam and a bracket. The bracket includes a first, e.g. planar, portion and a second, e.g. planar, portion that meet at a corner. The first portion is configured to fasten to the antenna back ring and the second portion is configured to attach to the horizontal beam. The second portion includes a pivot slot for receiving a first fastener connecting the bracket to the horizontal beam, and includes a circular hole for receiving a second fastener connecting the bracket to the horizontal beam.

20 Claims, 4 Drawing Sheets

300

LOAD-RESISTANT ANTENNA MOUNT

TECHNICAL FIELD

The present disclosure relates generally to the field of antenna mounting, and, more particularly, but not exclusively, to methods and apparatus useful for increasing resistance of antenna mounting hardware to loads imposed by, e.g. ice accumulation on the antenna.

BACKGROUND

This section introduces aspects that may be helpful to facilitate a better understanding of the inventions. Accordingly, the statements of this section are to be read in this light and are not to be understood as admissions about what is in the prior art or what is not in the prior art.

In cold environments, some large microwave antennas, e.g. (two meters or larger diameter) may accumulate a significant amount of snow and ice. An ice shield may be used to support the weight of the ice, and a sway bar may be used to prevent the antenna from rotating around the horizontal axis of its mounting hardware. However, in some installations, the ice shield and/or the sway bar may be undesirable or impractical. In many cases, without the ice shield and/or the sway bar, the antenna may suffer permanent damage and become unusable. For example, an elevation rod used to position the antenna direction relative to the horizon may deform, requiring inconvenient and costly repairs by the antenna operator.

SUMMARY

The inventor discloses various apparatus and methods that may be beneficially applied to mounting an antenna to an antenna tower. While such embodiments may be expected to provide improvements in performance and/or reduction of cost of relative to conventional approaches, no particular result is a requirement of the present invention unless explicitly recited in a particular claim.

The disclosure provides an improved mechanical assembly suitable for, e.g. attaching a microwave antenna dish to an antenna tower. The mechanical assembly includes a mounting bracket that includes a circular hole and a pivot slot. The circular hole provides an axis of rotation of the antenna dish, and the pivot adjustment slot provides fine granularity of adjustment of the radiation direction of the antenna dish within the limits of the slot. The improved assembly advantageously stabilizes the microwave antenna against the load imposed by vertical loads such as imposed by ice accumulation, thereby relieving other portions of the antenna assembly of mechanical loads that may exceed the yield strength of various components.

One embodiment provides a mechanical assembly for attaching to a tower structure an antenna having a reflector and a back ring attached to the reflector. The assembly includes a horizontal beam and an antenna mounting bracket. The bracket includes a first planar portion and a second planar portion that meets the first planar portion at a corner. The first planar portion is configured to fasten to the antenna back ring, and the second planar portion is configured to attach to the horizontal beam. The second planar portion includes a pivot slot for receiving a first fastener connecting the bracket to the horizontal beam, and further includes a circular hole for receiving a second fastener connecting the bracket to the horizontal beam.

In some embodiments the pivot slot follows a circular arc. In some embodiments the bracket is formed from ASTM A36 steel. In some embodiments the horizontal beam includes a captive nut for receiving the first fastener and a circular through-hole for receiving the second fastener. In some embodiments the first planar portion is welded to the second planar portion. In some embodiments the bracket has a native (e.g. non-galvanized) surface finish. In some embodiments the bracket is a first bracket attached to a first end of the horizontal beam, and the assembly includes a second bracket nominally identical to the first bracket and attached to a second end of the horizontal beam. In some embodiments the bracket, when attached to a back ring of an antenna reflector, provides an axis of rotation of the antenna reflector, and the pivot slot provides an adjustment of a vertical direction of the antenna reflector.

Another embodiment provides an antenna assembly for attachment to a vertical support beam. The antenna assembly includes an antenna reflector, a back ring attached to the antenna reflector, a horizontal beam, and an antenna bracket having a first portion and a second portion that meet at a corner. The first portion is configured to fasten to the antenna back ring and the second portion is configured to attach to the horizontal beam. The second portion includes a pivot slot for receiving a first fastener connecting the bracket to the horizontal beam, and includes a circular hole for receiving a second fastener connecting the bracket to the horizontal beam.

In some embodiments the pivot slot follows a circular arc that determines an extent of vertical adjustment of a radiation direction of the antenna reflector. In some embodiments the bracket is formed from ASTM A36 steel. In some embodiments the horizontal beam includes a captive nut for receiving the first fastener and a through-hole for receiving the second fastener. In some embodiments the bracket is a first bracket attached to a first end of the horizontal beam, and further comprising a second antenna bracket nominally identical to the first antenna bracket attached to a second end of the horizontal beam.

Yet another embodiment provides a method of forming an antenna assembly for attaching to a vertical beam. The method includes attaching an antenna mounting bracket to a horizontal beam. The bracket has a first planar portion and a second planar portion that meet at a corner. The first planar portion is configured to fasten to the antenna back ring, and the second planar portion is configured to attach to the horizontal beam. The second planar portion includes a pivot slot for receiving a first fastener, and includes a circular hole for receiving a second fastener. The method further includes attaching the second planar portion of the bracket to an end plate of the horizontal beam via the first and second fasteners, and attaching the first planar portion to a back ring of an antenna reflector.

BRIEF DESCRIPTION OF THE DRAWINGS

A more complete understanding of various embodiments may be obtained by reference to the following detailed description when taken in conjunction with the accompanying drawings wherein.

DETAILED DESCRIPTION

Figure 1B:
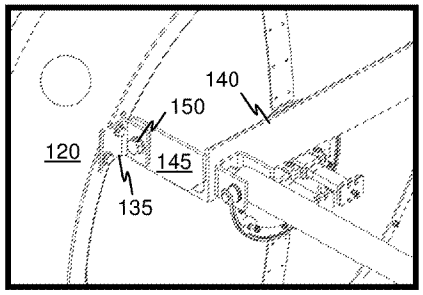
FIGS. 1A-1C illustrate aspects of a microwave antenna dish and a conventional mechanical assembly for attaching the antenna to a vertical beam.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

As described earlier, accumulated ice may impose significant mechanical loads on an antenna and associated hardware attaching the antenna to a tower. Such loads may, if sufficiently large, cause the direction of the antenna radiation pattern to be altered, requiring readjustment, or may even result in mechanical failure of some mechanical components, possibly causing service interruptions and requiring costly repairs. Indeed, service providers have been frustrated by the lack of suitable hardware to attach the antenna in a manner that resists such mechanical loads. Conventional attachment hardware may result in torque on some components that is translated to horizontal loads that exceed the yield strength of components designed to resist such torque. In some cases sway bars or similar structures may transfer some of the horizontal load to the tower structure, but such solutions may be unsuitable in some installations, e.g. those in which space is limited.

Embodiments provided herein overcome many of the limitations of conventional antenna mounting components by providing, inter alia, an antenna mounting bracket and a corresponding horizontal mounting beam. Whereas a conventional antenna mounting bracket includes a single mounting hole, the mounting bracket according to various embodiments includes two holes, a circular hole closer to the antenna dish, and a pivot slot further from the antenna dish. A first fastener, e.g. bolt, attaching the improved mounting bracket to the horizontal beam provides an axis of rotation for the antenna dish while supporting the majority of the vertical load of the dish assembly. The mounting bracket is allowed to rotate within the limits of the pivot slot to provide vertical adjustment of the antenna beam angle. When properly positioned, a second bolt through the pivot slot may be secured to prevent rotation of the mounting bracket. Because the first bolt supports the significant majority of the vertical load, the torque imposed by the antenna and any accumulated ice may be greatly reduced relative to conventional practice, reducing or eliminating the need for additional components to accommodate the horizontal loads produced by the torque. Thus reliability in adverse weather conditions may be improved and service costs reduced.

Figure 1C:
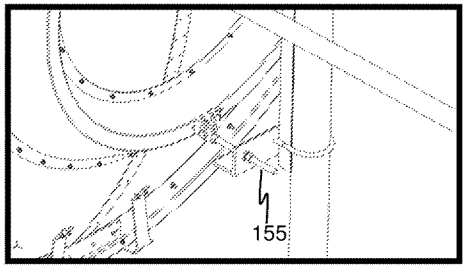
Figure 1A:
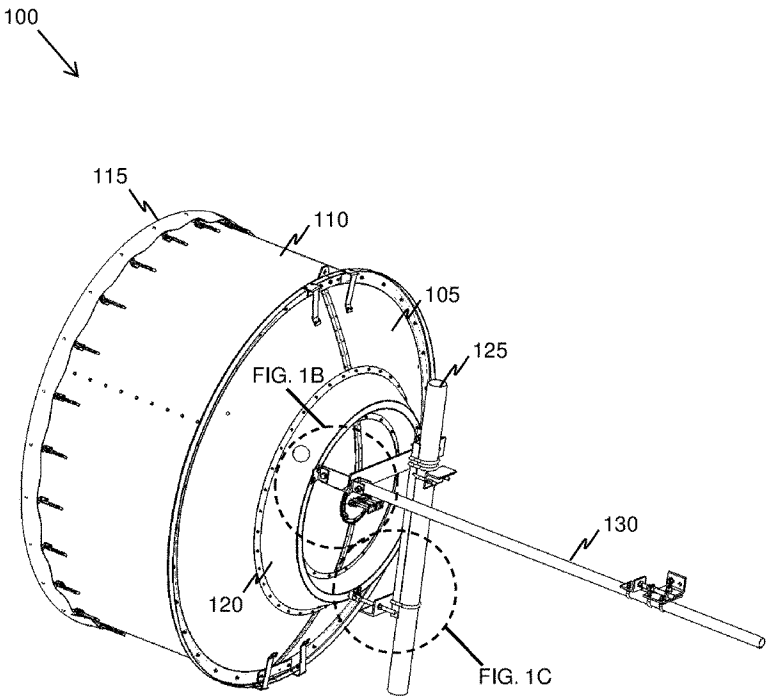

FIGS. 1A-1C illustrate a representative conventional antenna assembly 100. Referring to FIG. 1A, the assembly includes an antenna reflector, or dish, 105, a shroud 110 and a radome 115. A back ring 120 attached to the dish 105 provides an attachment point by which the dish 105 may be attached to a vertical beam, or pole, 125. A sway bar 130 may also be present to stabilize the dish 105.

FIG. 1B provides a detail view including the back ring 120. A bracket 135 is attached to the back ring 120 and to a horizontal beam 140 via an end plate 145. Consistent with conventional practice, the bracket 135 is attached to the end plate 145 by a single bolt 150 about which the dish 105 may rotate. Referring to FIG. 1C, an elevation adjustment rod 155 acts to stop rotation of the dish 105 and to transfer a portion of the horizontal load produced by the weight of the dish 105 and attached components to the tower structure.

Typically the adjustment rod 155 is used to adjust the vertical beam angle of the dish 105 while the bolt attaching the bracket 135 to the beam 140 is loose enough to allow rotation of the dish 105 about the axis of the bolt. After the beam angle is set, the bolt is then tightened. In the absence of an ice load, the friction between the bracket 135 and the end plate 145 is sufficient to prevent rotation of the dish 105, with the additional support of the adjustment rod 155. However, a sufficiently large ice load may cause the bracket 135 to slip, and the adjustment rod 155 to yield. Not only must the damage be repaired by a skilled technician at considerable cost, but the repair must wait until the ice is removed, either by warmer temperatures or by some other means.

Figure 2B:
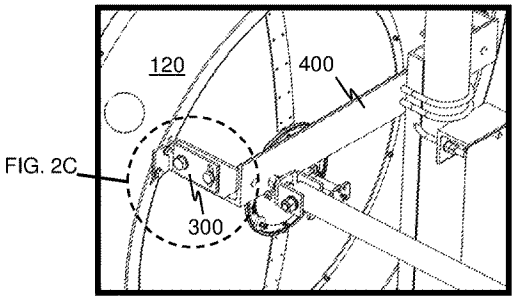
FIGS. 2A-2C illustrate aspects of a microwave antenna dish and a mechanical assembly for attaching the antenna to a vertical beam according to various embodiments.
Figure 2C:
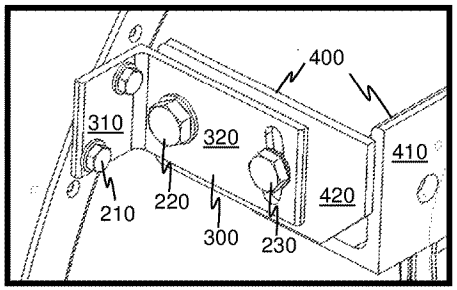
Figure 2A:
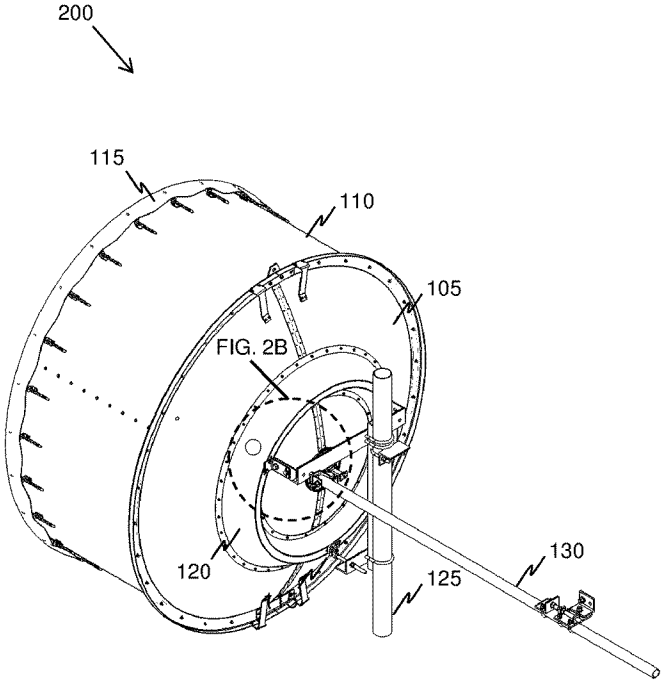

FIGS. 2A-2C illustrate aspects of an antenna assembly 200, according to embodiments of the invention, that may address deficiencies of conventional implementations. FIG. 2A illustrates the full antenna assembly 200, including several components shared with the conventional antenna assembly 100. FIG. 2B shows a detail view of a portion of the antenna assembly 200, including a portion of the back ring 120. Also shown are an antenna bracket 300 and a horizontal beam 400 according to various embodiments. As discussed further below in the context of FIG. 4, the horizontal beam 400 includes an angle bar section 410 and an end plate 420.

FIG. 2C illustrates a detail view of the antenna bracket 300 and the horizontal beam 400. The antenna bracket 300 may be attached to the back ring 120 conventionally via two bolts 210. However, contrary to conventional practice, two bolts 220, 230 attach the antenna bracket 300 to the end plate 420. The bolt 220 provides a pivot point, or axis of rotation, about which the antenna dish 105 may rotate. The bolt 230 when loose allows the angle of rotation of the antenna bracket 300 to be adjusted. When tightened, the bolts 220, 230 secure the antenna bracket 300 to the end plate 420 by friction between these two components. This feature is described further below.

Figure 3D:
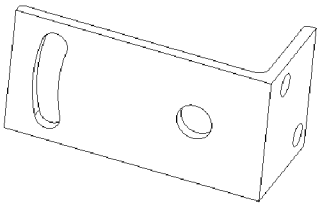
FIGS. 3A-3D illustrate aspects of an antenna mounting bracket configured according to various embodiments, e.g. have circular hole to attach the bracket to a horizontal beam, and a pivot hole to allow adjustment of the vertical direction of the antenna dish of FIG. 2A.
Figure 3C:
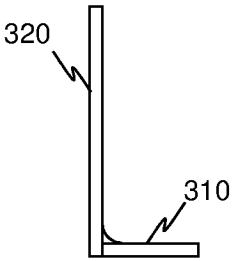
Figure 3A:
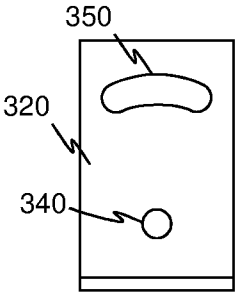
Figure 3B:
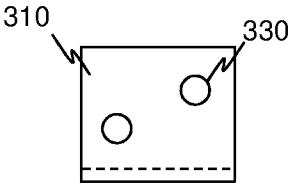

FIGS. 3A-3D illustrates various views of the antenna bracket 300, in which FIGS. 3A-3C show the mounting bracket in one embodiment in each of three orthogonal projections, while FIG. 3D shows the embodiment in a perspective projection. Referring to these figures concurrently, and with continued reference to FIGS. 2A-2C, the antenna bracket 300 includes a first, or minor, portion 310, and a second, or major, portion 320. The portions 310, 320 meet at a corner, and may be about orthogonal to each other, though embodiments are not limited to being orthogonal. The portions 310, 320 may be about planar, or may be shaped to conform to a mating surface. By "about planar", it is meant that the portions 310, 320 each generally follow the form of a geometric plane, while disregarding manufacturing tolerances that may lead to deviation from exact planarity. The first portion 310 includes two circular through-holes 330 that are each suitable for receiving a corresponding fastener, e.g. a bolt, for attaching the antenna bracket 300 to the back ring 120 of the antenna dish 105. While the illustrated embodiment is shown having two holes 330, any number of holes 330 may be used as suitable for the particular design of the antenna dish 105 to which the antenna bracket 300 is intended to attach.

The second portion 320 includes a circular through-hole 340 and a pivot slot 350. The hole 340 is suitable for receiving a fastener, e.g. a bolt, by which the antenna bracket 300 may be attached to the end plate 420 of the horizontal beam 400. In some embodiments an M16 bolt is preferred, which may be suitable to provide adequate friction between the antenna bracket 300 and the end plate 420. The hole 340 is located between the pivot slot 350 and the corner, making the hole 340 closer to, and the pivot slot 350 further from, the antenna dish 105 when the antenna bracket 300 is attached to the back ring 120. It is preferred that the pivot slot 350 follow a circular arc with a radius of curvature about equal to the distance between the center of the hole 340 and the pivot slot 350 to allow unhindered rotation of the antenna dish 105 about the axis of the bolt within the hole 340. The pivot slot 350 determines the extent of vertical adjustment of the radiation direction of the antenna reflector 105. In some embodiments the pivot slot 350 may allow the beam direction to be adjusted between about ±15° of horizontal, but this value may easily be adapted to the requirements of a particular installation.

While the antenna bracket 300 may be formed of any suitable material, it is expected that in typical applications a structural steel alloy will be preferable. In some embodiments an alloy such as ASTM standard A36 low-carbon steel is a suitable alloy. The antenna bracket 300 may be formed by joining the portions 310, 320 via welding (as shown without limitation thereto in FIG. 3C), by forming a corner in a single work piece, by casting, or machining a section of angle-bar. The surface of the antenna bracket 300 may be of any type, e.g. native (unfinished), anodized or galvanized. In some embodiments the native finish may be preferable due to greater friction coefficient between the antenna bracket 300 and the end plate 420 of the native finish relative to an anodized or galvanized finish.

Figure 4:
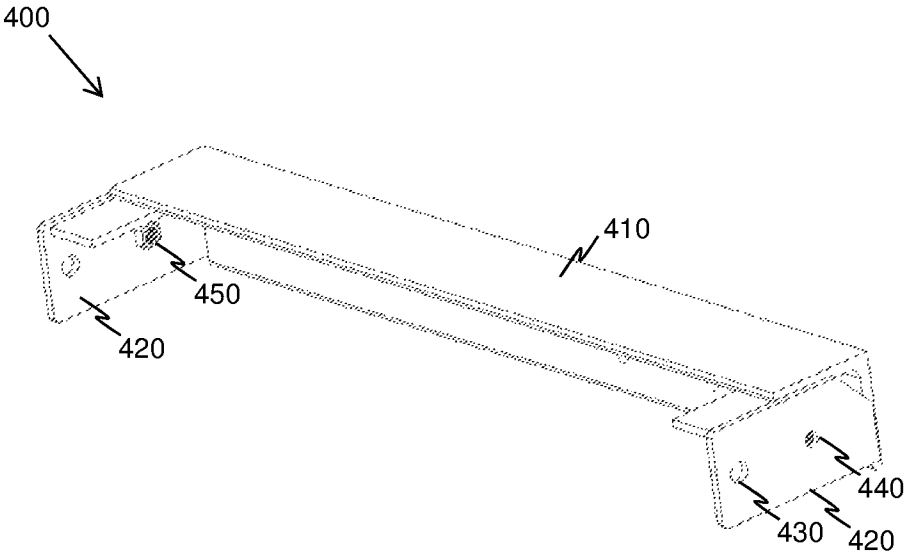
FIG. 4 illustrates an embodiment of a horizontal beam suitable for attachment to the mounting bracket of FIGS. 3A-3D.

FIG. 4 illustrates the horizontal beam 400 in greater detail in an example embodiment. While the term "horizontal" is sometimes used to describe the beam 400, the term is not meant in a limiting sense, e.g. does not require that the beam 400 be oriented parallel to the Earth horizon to fall within the scope of the description and the claims. Instead, the term refers to the designed use of the beam 400 to provide a generally horizontal support structure to antenna components while attached to a generally vertical tower structure. The horizontal beam 400 includes an angle-bar section 410 and an end plate 420 at each end of the section 410. The end plates 420 may be welded to the section 410, and are nominally identical minor images. Herein and in the claims, two features may be considered nominally identical when they are approximately minor images of each other. The end plates 420 each include a through-hole 430 suitable for receiving the bolt 220 via the hole 340 (see FIGS. 2C and 3A). The end plates 420 also each include a through-hole 440 that may, and in the illustrated embodiment does, include a captive nut that may be attached to the end plate 420 by welding. The hole 440 is suitable for receiving the bolt 230 that passes through the pivot slot 350 (see FIGS. 2C and 3A). The angle-bar section 410 and the end plates 420 may be formed from any suitable material, optionally A36 steel with a native finish.

The antenna assembly 200 preferably includes two instances of the antenna bracket 300 that are nominally identical, e.g. minor images, each one being attached to a corresponding one of the end plates 420. The mounting brackets 300 may be attached to corresponding locations on the back ring 120 to provide symmetric support of the antenna dish 105. While the sway bar 130 may be used if desired, in some cases it is expected that the vertical support and rotational friction will render unnecessary the sway bar 130, thereby advantageously providing vertical stabilization of the reflector 105 in space-constrained applications in which the sway bar is impractical or effectively impossible to accommodate.

Although multiple embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they formally fall within the scope of the claims.

The description and drawings merely illustrate the principles of the invention. It will thus be appreciated that those of ordinary skill in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A mechanical assembly for attaching to a tower structure an antenna having a reflector and a back ring attached to the reflector, the assembly comprising:

a horizontal beam; and a bracket having a first planar portion and a second planar portion that meet at a corner, the first planar portion being configured to fasten to said antenna back ring and said second planar portion being configured to attach to said horizontal beam, wherein said second planar portion includes a pivot slot for receiving a first fastener connecting said bracket to said horizontal beam, and includes a circular hole for receiving a second fastener connecting said bracket to said horizontal beam.

2. The mechanical assembly of claim 1, wherein said pivot slot follows a circular arc.

3. The mechanical assembly of claim 1, wherein said bracket is formed from ASTM A36 steel.

4. The mechanical assembly of claim 1, wherein said horizontal beam includes a circular hole for receiving said first fastener and a captive nut for receiving said second fastener.

5. The mechanical assembly of claim 1, wherein said first planar portion is welded to said second planar portion.

6. The mechanical assembly of claim 1, wherein said bracket has a native finish.

7. The mechanical assembly of claim 1, wherein said bracket is a first bracket attached to a first end of said horizontal beam, and further comprising a second bracket nominally identical to said first bracket attached to a second end of said horizontal beam.

8. The mechanical assembly of claim 1, wherein when attached to a back ring of an antenna reflector, said bracket provides an axis of rotation of said antenna reflector, and said pivot slot provides an adjustment of a vertical direction of said antenna reflector.

9. An antenna assembly configured to attach to a vertical beam, comprising:

an antenna reflector;

a back ring attached to said antenna reflector;

a horizontal beam; and a bracket having a first portion and a second portion that meet at a corner, the first portion being configured to fasten to said antenna back ring and said second portion being configured to attach to said horizontal beam, wherein said second portion includes a pivot slot for receiving a first fastener connecting said bracket to said horizontal beam, and includes a circular hole for receiving a second fastener connecting said bracket to said horizontal beam.

10. The antenna assembly of claim 9, wherein said pivot slot follows a circular arc that determines an extent of vertical adjustment of a radiation direction of said antenna reflector.

11. The antenna assembly of claim 9, wherein said bracket is formed from ASTM A36 steel.

12. The antenna assembly of claim 9, wherein said horizontal beam includes a captive nut for receiving said first second fastener and a through-hole for receiving said second fastener.

13. The antenna assembly of claim 9, wherein said bracket is a first bracket attached to a first end of said horizontal beam, and further comprising a second bracket nominally identical to said first bracket attached to said back ring and to a second end of said horizontal beam.

14. The antenna assembly of claim 9, wherein said first and second portions are about planar.

15. A method of forming an antenna assembly for attaching to a vertical beam, comprising:

providing a horizontal beam having an end plate and a bracket attached to said end plate, the bracket having a first planar portion and a second planar portion that meet at a corner, the first planar portion being configured to fasten to said antenna back ring and said second planar portion being configured to attach to said horizontal beam, wherein said second planar portion includes a pivot slot for receiving a first fastener, and includes a circular hole for receiving a second fastener;

attaching said bracket to said second planar portion to said end plate of said horizontal beam via said first and second fasteners; and attaching said first planar portion to a back ring of an antenna reflector.

16. The method of claim 15, wherein said bracket is formed from ASTM A36 steel.

17. The method of claim 15, wherein said pivot slot follows a circular arc that determines an extent of vertical adjustment of a radiation direction of said antenna reflector.

18. The method of claim 15, wherein said horizontal beam includes a captive nut for receiving said first fastener and a through-hole for receiving said second fastener.

19. The method of claim 15, wherein said bracket is a first bracket attached to a first end of said horizontal beam, and further comprising a second bracket nominally identical to said first bracket attached to a second end of said horizontal beam and to said back ring.

20. The method of claim 15, wherein said first and second planar portions are welded together at said corner.

* * * * *